US011046916B2

(12) United States Patent
Tabuchi et al.

(10) Patent No.: US 11,046,916 B2
(45) **Date of Patent: *Jun. 29, 2021**

(54) SURFACTANT COMPOSITION

(71) Applicant: KAO CORPORATION, Tokyo (JP)

(72) Inventors: Yukiko Tabuchi, Izumiotsu (JP); Takaya Sakai, Wakayama (JP); Makiko Shigehisa, Odawara (JP); Hiroko Endo, Musashino (JP)

(73) Assignee: KAO CORPORATION, Tokyo (JP)

( * ) Notice: Subject to any disclaimer, the term of this patent is extended or adjusted under 35 U.S.C. 154(b) by 53 days.

This patent is subject to a terminal disclaimer.

(21) Appl. No.: 16/305,510

(22) PCT Filed: May 30, 2017

(86) PCT No.: PCT/JP2017/020051

§ 371 (c)(1),
(2) Date: Nov. 29, 2018

(87) PCT Pub. No.: WO2017/209114

PCT Pub. Date: Dec. 7, 2017

(65) Prior Publication Data

US 2020/0231902 A1 Jul. 23, 2020

(30) Foreign Application Priority Data

May 31, 2016 (JP) ..... JP2016-108266

(51) Int. Cl.
*C11D 1/00* (2006.01)
*C11D 1/831* (2006.01)

(52) U.S. Cl.
CPC ..... *C11D 1/831* (2013.01)

(58) Field of Classification Search
None
See application file for complete search history.

(56) References Cited

U.S. PATENT DOCUMENTS

| | | | | |
|---|---|---|---|---|
| 3,332,880 | A | 7/1967 | Kessler et al. | |
| 4,029,608 | A | 6/1977 | Murata et al. | |
| 4,272,396 | A | 6/1981 | Fukano et al. | |
| 4,715,991 | A | 12/1987 | Hirakouchi et al. | |
| 4,880,569 | A | 11/1989 | Leng et al. | |
| 5,078,916 | A | 1/1992 | Kok et al. | |
| 2012/0270764 | A1* | 10/2012 | Brown | C07C 309/17 510/427 |
| 2014/0076344 | A1 | 3/2014 | Doi et al. | |
| 2015/0202133 | A1 | 7/2015 | Doi et al. | |
| 2015/0275133 | A1* | 10/2015 | Doi | A61Q 5/02 510/127 |

FOREIGN PATENT DOCUMENTS

| | | | |
|---|---|---|---|
| CA | 946249 | A | 4/1974 |
| CA | 2026746 | A1 | 4/1991 |
| CN | 86102800 | A | 1/1987 |
| JP | 52-41612 | A | 3/1977 |
| JP | 3-126793 | A | 5/1991 |
| JP | 9-176684 | A | 7/1997 |
| JP | 9-316488 | A | 12/1997 |
| JP | 2001-342500 | A | 12/2001 |
| JP | 2003-238999 | A | 8/2003 |
| JP | 2015-27976 | A | 2/2015 |
| JP | 2015-27977 | A | 2/2015 |
| RU | 2337947 | C2 | 11/2008 |
| WO | WO 2004/063320 | A1 | 7/2004 |
| WO | WO 2014/046300 | A2 | 3/2014 |

OTHER PUBLICATIONS

Russian Office Action and Search Report, dated Mar. 12, 2020, for Russian Application No. 2018146491, with an English translation.
English translation of the Chinese Search Report, dated Jan. 15, 2020, for corresponding Chinese Application No. 2017800324125.
Extended European Search Report, dated Jan. 30, 2020, for corresponding European Application No. 17806667.6.
International Search Report, issued in PCT/JP2017/020051, dated Jul. 25, 2017.
International Preliminary Report on Patentability with English translation of the International Searching Authority (Forms PCT/IB/338, PCT/IB/373 and PCT/ISA/237) for International Application No. PCT/JP2017/020051, dated Dec. 13, 2018.
English translation of Taiwanese Search Report, dated Jul. 29, 2020, for Taiwanese Application No. 106117864.
English translation of Chinese Search Report, dated Oct. 15, 2020, for Chinese Patent Application No. 201780032412.5.
English Translation of the Taiwanese Search Report, dated Dec. 23, 2020, for Taiwanese Application No. 106117864.

* cited by examiner

*Primary Examiner* — Necholus Ogden, Jr.
(74) *Attorney, Agent, or Firm* — Birch, Stewart, Kolasch & Birch, LLP

(57) ABSTRACT

Provided is a surfactant composition which includes high concentrations of a surfactant, has fluidity in a wide concentration range, and does not become clouded when diluted with hard water. This surfactant composition includes component A, component B, and component C described below, wherein a total content of the component A and the component B is 35 to 80% by mass and wherein the component A is at least one sulfonate compound selected from the group consisting of a hydroxyalkane sulfonate and an olefin sulfonate, the component B is a polyoxyalkylene alkyl ether, and the component C is water.

9 Claims, No Drawings

SURFACTANT COMPOSITION

TECHNICAL FIELD

The present invention relates to a surfactant composition. More particularly, the present invention relates to a surfactant composition including a high concentration of a surfactant and having fluidity in a wide concentration range.

BACKGROUND ART

Various forms of detergents exist in the market, and liquid detergents are provided for a wide range of cleaning applications such as clothing use, residential use, hair use, body use, and the like. Since the liquid detergent has high solubility even during winter season and less worry of an undissolved residue, there is an advantage that such a liquid detergent is easy to use and can exhibit a stable and high detergency. Since the liquid detergent can be used in various bottles such as a dispenser and a pump foamer, it is also widely applied as a detergent. Due to these advantages, liquid detergents have been growing in the market, and among them, a concentrated liquid detergent which is reduced in size of the detergent itself by blending a high concentration of a surfactant is easier to use because the concentrated liquid detergent can reduce one use amount and becomes a more compact product, which leads to a reduction in container resin amount, transportation cost, and energy. Thus, such a concentrated liquid detergent is attracting attention as environment awareness rises.

In this way, further concentration of a liquid detergent is very important as a technology contributing to economic effects due to improved convenience of products, and reduction of environmental burden.

Patent Document 1 discloses a concentrated liquid detergent composition which can be liquid and uniform at a normal storage temperature and comprises a polyalkoxy nonionic surfactant and an ionic surfactant having a non-terminal ionic functional group.

Also, Patent Document 2 discloses a detergent composition excellent in detergency comprising an internal olefin sulfonate having from 8 to 26 carbon atoms, wherein at least 25% by weight of the internal olefin sulfonate has a beta-hydroxyalkane sulfonate structure.

In addition, Patent Document 3 discloses a detergent composition including, as the major components, (i) an anionic surfactant which is an internal olefin sulfonate, a vinylidene sulfonate, or a mixture thereof, and (ii) a nonionic surfactant having an HLB value of 10.5 or less, wherein the weight ratio of (i) to (ii) is in the range of 9:1 to 1:9.

In addition, Patent Document 4 discloses a skin or hair detergent composition which contains an internal olefin sulfonate (A) having 12 to 24 carbon atoms, excellent in foam sustainability and rinsing property.

The detergent composition in which a surfactant is blended at a high concentration has a problem that the solubility of the detergent composition is lowered to cause precipitates or generate a strong gel, so that the usability is remarkably impaired. Therefore, in many liquid detergents, a large amount of organic solvent is used in combination in order to sufficiently dissolve the surfactant and maintain its fluidity.

On the other hand, many organic solvents are petrochemicals, and it is desired to refrain from using organic solvents in view of sustainability, environmental burden, safety, and the like. In addition, by ensuring the fluidity of the detergent without depending on the organic solvent, foaming at the time of using the liquid detergent and viscosity control suitable for various uses become easy.

Therefore, there is a demand for a detergent composition capable of uniformly dissolving without gel formation even if a surfactant is blended at a high concentration to reduce the amount of the organic solvent used, as well as capable of maintaining fluidity in a wide concentration range without impairing the fluidity even when the concentration is changed by dilution or the like.

However, the technique disclosed in the above patent documents is not sufficient for providing a detergent composition containing a surfactant at a high concentration and maintaining fluidity in a wide concentration range with a low viscosity. In addition, the conventional detergent composition has problems of clouding or deteriorating detergency when diluted with hard water.

PRIOR ART DOCUMENTS

Patent Documents

Patent Document 1: U.S. Pat. No. 4,880,569
Patent Document 2: U.S. Pat. No. 5,078,916
Patent Document 3: JP-A-H3-126793
Patent Document 4: JP-A-2015-27977

SUMMARY OF THE INVENTION

Problems to be Solved by the Invention

The present invention relates to a surfactant composition which includes a high concentration of a surfactant, has fluidity in a wide concentration range, and does not become clouded even when diluted with hard water.

Means for Solving the Problems

As a result of intensive studies, the present inventors have found that the problems can be solved by blending a specific anionic surfactant and a specific nonionic surfactant in specific amounts.

The present invention is related to a surfactant composition including component A, component B, and component C described below, wherein a total content of the component A and the component B is 35% by mass or more and 80% by mass or less and wherein the component A is at least one sulfonate compound selected from the group consisting of a hydroxyalkane sulfonate and an olefin sulfonate, the component B is a polyoxyalkylene alkyl ether, and the component C is water.

Effect of the Invention

According to the present invention, a surfactant composition including a surfactant at a high concentration and having fluidity in a wide concentration range is obtained. Therefore, the amount of an organic solvent to be used in the surfactant composition can be greatly reduced. Further, the surfactant composition of the present invention has properties such that it does not become clouded even when diluted with hard water.

MODE FOR CARRYING OUT THE INVENTION

Hereinafter, the present invention will be described in detail.

A surfactant composition of the present invention includes component A, component B, and component C described below, wherein a total content of the component A and the component B is 35% by mass or more and 80% by mass or less and wherein the component A is at least one sulfonate compound selected from the group consisting of a hydroxyalkane sulfonate and an olefin sulfonate, the component B is a polyoxyalkylene alkyl ether, and the component C is water.

The surfactant composition of the present invention is excellent in fluidity from a high concentration to a low concentration by containing a specific amount of the components A and B. The reason why such characteristics are developed is not certain but can be thought as follows. The molecular structure of the surfactant is largely distinguished between hydrophilic groups and hydrophobic groups, but in a highly concentrated aqueous surfactant solution, the interaction between the hydrophobic groups is strong, so that aggregation of the surfactant occurs to cause the increase of viscosity in the aqueous solution. However, it is presumed that by blending the component A and the component B in combination, the regularity of the orientation of the hydrophobic groups is reduced and thus the aggregation of the surfactant can be suppressed. However, such action is a presumption and does not restrict the scope of the present invention.

<Component A>

As the sulfonate compound, known ones can be used without particular limitation, but from the viewpoint of further improving the effects of the present invention, the sulfonate compound has a carbon number of preferably 12 or more, more preferably 14 or more, still more preferably 16 or more, and preferably 24 or less, more preferably 22 or less, still more preferably 20 or less, even still more preferably 18 or less. These may be used singly or two or more kinds thereof having different carbon numbers may be used in combination.

The sulfonate compound can be obtained, for example, by sulfonating an internal olefin as a raw material (an olefin having a double bond inside the olefin chain), followed by neutralization and hydrolysis. Incidentally, such an internal olefin is a broad meaning including a case where a trace amount of so-called α-olefin in which the double bond exists at the 1-position of the carbon chain is contained. That is, when the internal olefin is sulfonated, β-sultone is produced quantitatively, and a part of β-sultone is changed to γ-sultone and olefin sulfonic acid, and these are then converted into a hydroxyalkane sulfonate and an olefin sulfonate in the neutralization/hydrolysis step (for example, J. Am. Oil Chem. Soc. 69, 39 (1992)). Here, the hydroxy group of the resulting hydroxyalkane sulfonate is within the carbon chain and the double bond of the olefin sulfonate is within the carbon chain. The products obtained are predominantly mixtures of these and some of them include a hydroxyalkane sulfonate having a hydroxy group at the end of the carbon chain or an olefin sulfonate having a double bond at the end of the carbon chain are contained in trace amounts. In the present invention, the hydroxyalkane sulfonate has a hydroxyl group within the carbon chain and may optionally contain a hydroxyalkane sulfonate having a hydroxy group at the end of the carbon chain. In the present invention, the olefin sulfonate has a double bond within the carbon chain and may optionally contain an olefin sulfonate having a double bond at the end of the carbon chain. Here, the hydroxyalkane sulfonate is also referred to simply as a hydroxy form (hereinafter also referred to as HAS) and the olefin sulfonate is also referred to simply as an olefin form (hereinafter also referred to as IOS).

Component A is a hydroxyalkane sulfonate, an olefin sulfonate, or a mixture thereof, but is preferably a mixture thereof. In the case of a mixture, the mass ratio (hydroxy form/olefin form) of the content of the hydroxyalkane sulfonate to the content of the olefin sulfonate is preferably 50/50 to 99/1, more preferably 60/40 to 99/1, even more preferably 70/30 to 99/1, still even more preferably 75/25 to 99/1, yet still even more preferably 75/25 to 95/5, from the viewpoint of hue improvement, productivity improvement, and impurity reduction of the resulting surfactant composition.

The mass ratio of the content of the hydroxyalkane sulfonate to the content of the olefin sulfonate in the component A or the surfactant composition can be determined by separating the hydroxyalkane sulfonate and the olefin sulfonate from the component A or the obtained surfactant composition through HPLC, followed by measurement according to the method described in Examples.

From the viewpoint of further improving the effects of the present invention, the sulfonate compound preferably contains 40% by mass or less, more preferably 35% by mass or less, even more preferably 30% by mass or less, still even more preferably 28% by mass or less, of a sulfonate compound having a sulfonate group at the 2-position. Also, it is preferable to contain 5% by mass or more of a sulfonate compound having a sulfonate group at the 2-position.

The sulfonate compound can be produced by a known method, for example, by sulfonating, neutralizing, and hydrolyzing an internal olefin. Each step will be specifically described below.

[Sulfonation Step]

The sulfonation step is a step of reacting an internal olefin with sulfur trioxide to obtain a sulfonated product.

The internal olefin is an olefin having a double bond within the olefin chain. The internal olefin may contain a trace amount of so-called α-olefin in which the double bond is present at the 1-position of the carbon chain.

In order to obtain the sulfonate compound, the internal olefin contains an internal olefin having a double bond at the 2-position in an amount of preferably 40% by mass or less, more preferably 35% by mass or less, even more preferably 30% by mass or less, still even more preferably 28% by mass or less, and from the viewpoint of productivity of the internal olefin, the content of such an internal olefin is preferably 10% by mass or more, more preferably 15% by mass or more.

In order to obtain the sulfonate compound, the number of carbon atoms of the internal olefin is preferably 12 or more, more preferably 14 or more, even more preferably 16 or more, and is preferably 24 or less, more preferably 22 or less, even more preferably 20 or less, still even more preferably 18 or less.

The internal olefin can be produced by a known method, for example, a method described in WO 2011/052732.

Sulfur trioxide is not particularly limited, but from the viewpoint of improving the reactivity, it is preferable to use sulfur trioxide gas.

From the viewpoint of improving the yield of the sulfonated product, the sulfonation conversion rate is preferably 95% or more, more preferably 97% or more, even more preferably 98% or more, and from the viewpoint of suppressing coloring of the sulfonated product due to an excess amount of $SO_3$, the sulfonation conversion rate is preferably 99.8% or less.

[Neutralization Step]

The neutralization step is a step of reacting a sulfonated compound with an alkali compound to obtain a neutralized product. The alkali compound is preferably used as an alkaline aqueous solution.

[Hydrolysis Step]

The hydrolysis step is a step of hydrolyzing the resulting neutralized product.

In the hydrolysis step, the temperature during the hydrolysis is preferably 120° C. or more, more preferably 140° C. or more, even more preferably 160° C. or more, from the viewpoint of improving the reactivity, and is preferably 220° C. or less, more preferably 180° C. or less, from the viewpoint of suppressing the decomposition of the product.

From the viewpoint of completing the reaction, the treatment time of the hydrolysis step is preferably 30 minutes or more, more preferably 45 minutes or more, and from the viewpoint of improving the productivity, the treatment time of the hydrolysis step is preferably 4 hours or less, more preferably 3 hours or less, even more preferably 2 hours or less, still even more preferably 90 minutes or less.

From the viewpoint of the productivity, the concentration of the aqueous solution containing the sulfonate compound obtained by the hydrolysis step is preferably 15% by mass or more, more preferably 30% by mass or more, even more preferably 40% by mass or more, still even more preferably 45% by mass or more, yet still even more preferably 48% by mass or more, yet furthermore preferably 50% by mass or more, and from the viewpoint of the viscosity etc. of the aqueous solution, the concentration of the aqueous solution is preferably 75% by mass or less, more preferably 70% by mass or less, even more preferably 65% by mass or less, still even more preferably 60% by mass or less.

The obtained sulfonate compound can be used as it is, but further purification such as desalting and decolorization may be carried out.

<Component B>

As the polyoxyalkylene alkyl ether, known ones can be used without particular limitation, but from the viewpoint of further improving the effect of the present invention, use of a polyoxyalkylene alkyl ether represented by the following general formula (1) is preferable. These may be used singly or in combination of two or more thereof.

$$R—O-(AO)_a—H \quad (1)$$

In the above formula, R is a hydrocarbon group having 8 to 22 carbon atoms, AO is an alkyleneoxy group, and n is 5 or more.

The number of carbon atoms of the hydrocarbon group is preferably 10 or more, more preferably 12 or more, and preferably 18 or less, more preferably 16 or less, even more preferably 14 or less, from the viewpoint of further improving the effect of the present invention.

The hydrocarbon group may be linear or branched.

Examples of the alkyleneoxy group include an ethyleneoxy group, a propyleneoxy group, a butyleneoxy group, and the like.

The "n" represents an average number of moles of the alkyleneoxy group and is preferably 7 or more, more preferably 10 or more, even more preferably 12 or more, and preferably 100 or less, more preferably 40 or less, even more preferably 30 or less, from the viewpoint of further improving the effect of the present invention.

The AO may be one kind of alkyleneoxy group or two or more kinds of alkyleneoxy groups. The AO is preferably one or more kinds selected from an ethyleneoxy group and a propyleneoxy group; more preferably, the AO contains an ethyleneoxy group and a propyleneoxy group; even more preferably, the AO has a block structure comprising an ethyleneoxy group and a propyleneoxy group, from the viewpoint of further improving the effect of the present invention.

Examples of the polyoxyalkylene alkyl ether include lauryl ether added with 15 to 25 moles of ethyleneoxy groups, lauryl ether added with a total of 15 to 25 moles of ethyleneoxy groups and propyleneoxy groups, myristyl ether added with 15 to 25 moles of ethyleneoxy groups, myristyl ether added with a total of 15 to 25 moles of ethyleneoxy groups and propyleneoxy groups, cetyl ether added with 15 to 25 moles of ethyleneoxy groups, cetyl ether added with a total of 15 to 25 moles of ethyleneoxy groups and propyleneoxy groups, stearyl ether added with 15 to 25 moles of ethyleneoxy groups, and stearyl ether added with a total of 15 to 25 moles of ethyleneoxy groups and propyleneoxy groups, among which lauryl ether added with 15 to 25 moles of ethyleneoxy groups, lauryl ether added with a total of 15 to 25 moles of ethyleneoxy groups and propyleneoxy groups, myristyl ether added with 15 to 25 moles of ethyleneoxy groups, and myristyl ether added with a total of 15 to 25 moles of ethyleneoxy groups and propyleneoxy groups are preferable, and lauryl ether added with a total of 15 to 25 moles of ethyleneoxy groups and propyleneoxy groups is more preferable.

<Component C>

The component C contained in the surfactant composition of the present invention is water and is not particularly limited, but purified water such as ion-exchange water, distilled water, and reverse osmosis water is preferable.

<Surfactant Composition>

The surfactant composition of the present invention contains at least the components A, B, and C.

The total content of the component A and the component B is 35% by mass or more and 80% by mass or less from the viewpoint of improving the effect of the present invention. From the viewpoint of further improving the effect of the present invention, the total content of the component A and the component B can be 40% by mass or more, 45% by mass or more, 50% by mass or more, 55% by mass or more, or 60% by mass or more, and can be 75% by mass or less, 70% by mass or less, or 65% by mass or less.

The mass ratio A/B of the content of the component A to the content of the component B is preferably from 20/80 to 80/20, more preferably from 30/70 to 70/30, even more preferably from 40/60 to 60/40, from the viewpoint of further improving the effect of the present invention.

The content of the component A is not particularly limited as long as the total content of the component A and the component B is in a range satisfying the above conditions. The content of the component A in the composition may be, for example, 5% by mass or more, 10% by mass or more, 15% by mass or more, 20% by mass or more, 30% by mass or more, 40% by mass or more, or 50% by mass or more. Also, the content of the component A may be, for example, 75% by mass or less, 70% by mass or less, 65% by mass or less, 60% by mass or less, or 55% by mass or less.

The content of the component B is not particularly limited as long as the total content of the component A and the component B is in a range satisfying the above conditions. The content of the component B in the composition may be, for example, 5% by mass or more, 10% by mass or more, 15% by mass or more, 20% by mass or more, 30% by mass or more, 40% by mass or more, or 50% by mass or more. Also, the content of the component B may be, for example, 75% by mass or less, 70% by mass or less, 65% by mass or less, 60% by mass or less, or 55% by mass or less.

The component C, that is, water, can be used in an amount that will be the remainder of the components A, B and other components. The content of the component C in the composition can be 5% by mass or more, 10% by mass or more, 15% by mass or more, 20% by mass or more, or 25% by mass or more, and 65% by mass or less, 60% by mass or less, 55% by mass or less, 50% by mass or less, 45% by mass or less, 40% by mass or less, or 35% by mass or less.

The viscosity at 25° C. of the surfactant composition of the present invention is preferably 8000 mPa·s or less, more preferably 7000 mPa·s or less, even more preferably 6000 mPa·s or less, still even more preferably 5000 mPa·s or less, further preferably 4000 mPa·s or less, furthermore preferably 3500 mPa·s or less, furthermore preferably 3000 mPa·s or less, furthermore preferably 2000 mPa·s or less, furthermore preferably 1000 mPa·s or less, furthermore preferably 500 mPa·s or less, furthermore preferably 300 mPa·s or less, furthermore preferably 200 mPa·s or less, from the viewpoint of ease of handling. The lower limit of the viscosity at 25° C. is not particularly limited. Here, the viscosity is measured by a tuning fork type vibrational viscometer (VIBRO VISCOMETER SV-10, manufactured by A & D Co., Ltd.) according to the method described in the Examples.

The viscosity at 25° C. may be 0 mPa's or more. Here, the viscosity of 0 mPa·s includes a case where the viscosity cannot be measured with a tuning fork type vibrational viscometer because the viscosity is too low.

The viscosity at 25° C. may be, for example, 5 mPa·s or more, 10 mPa·s or more, 20 mPa·s or more, 30 mPa·s or more, 40 mPa·s or more, or 50 mPa·s or more.

From the viewpoint of stability of the composition, the surfactant composition of the present invention is homogeneously dissolved preferably at 25° C.

With respect to the hue of the surfactant composition of the present invention, the Hazen color number (APHA) is preferably 550 or less, more preferably 400 or less, even more preferably 300 or less, still even more preferably 200 or less, from the viewpoint of quality.

<Other Components>

The surfactant composition of the present invention may optionally contain, in addition to component A, component B and component C, components used in a detergent, such as a surfactant other than component A and component B, a solvent, a perfume, a dye, a preservative, a humectant, an antibacterial agent, an anti-dandruff agent, a pearling agent, a vitamin agent, a thickener, a pH adjuster, a bleaching agent, a chelating agent, a water-soluble salt, an oil and the like.

Surfactants Other than Component A and Component B

Examples of the surfactant other than the component A and the component B include an anionic surfactant other than the component A, a nonionic surfactant other than the component B, an amphoteric surfactant, and a cationic surfactant.

Examples of the anionic surfactant other than the component A include sulfate ester salts such as alkyl sulfate salt, alkenyl sulfate salt, polyoxyalkylene alkyl ether sulfate salt, polyoxyalkylene alkenyl ether sulfate salt, and polyoxyalkylene alkyl phenyl ether sulfate salt; sulfonate salts such as alkyl sulfosuccinate ester salt, polyoxyalkylene alkyl sulfosuccinate ester salt, alkane sulfonate, acyl isethionates, and acyl methyl taurate; higher fatty acid salts having 8 to 16 carbon atoms; phosphoric acid ester salts such as alkyl phosphate salts and polyoxyalkylene alkyl ether phosphate salts; and amino acid salts such as acyl glutamate salts, alanine derivatives, glycine derivatives, and arginine derivatives.

Examples of the nonionic surfactants other than component B include polyethylene glycol types such as polyoxyethylene sorbitan fatty acid ester, polyoxyethylene sorbitol fatty acid ester, polyoxyethylene glycerin fatty acid ester, polyoxyethylene fatty acid ester, polyoxyethylene alkylphenyl ether, and polyoxyalkylene castor oil (hardened); polyhydric alcohol types such as sucrose fatty acid ester, polyglycerin alkyl ether, polyglycerin fatty acid ester, alkyl glycoside, and acylated alkyl glucamide; fatty acid alkanol amide, and the like. Specific examples thereof include fatty acid monoalkanol amides such as coconut oil fatty acid monoethanolamide and coconut oil fatty acid N-methyl monoethanolamide.

Examples of the amphoteric surfactant include betaine type surfactants such as imidazoline type betaine, alkyldimethylaminoacetic acid betaine, fatty acid amido propyl betaine, and sulfobetaine; amine oxide type surfactants such as alkyldimethylamine oxide; and the like. Specific examples thereof include coconut oil fatty acid amidopropyldimethylcarbobetaine, lauramidopropyl dimethylcarbobetaine, laurylcarboxymethyl hydroxyimidazolium betaine, lauryldimethylaminoacetic acid betaine, laurylhydroxysulfobetaine, and the like.

Examples of the cationic surfactant include a quaternary ammonium salt having a hydrocarbon group with 12 to 28 carbon atoms which may be interrupted with an amide group, an ester group or an ether group; a pyridinium salt; a salt of a tertiary amine with a mineral acid or an organic acid; and the like. Specific examples thereof include monolong chain alkyltrimethyl ammonium salts such as octyltrimethyl ammonium salt, decyltrimethyl ammonium salt, lauryltrimethyl ammonium salt, myristyltrimethyl ammonium salt, cetyltrimethyl ammonium salt, stearyltrimethyl ammonium salt, behenyltrimethyl ammonium salt, and octadecyloxypropyltrimethyl ammonium salt; di-long chain alkyldimethyl ammonium salts such as dioctyldimethyl ammonium salt, didecyldimethyl ammonium salt, dilauryldimethyl ammonium salt, dimyristyldimethyl ammonium salt, dicetyldimethyl ammonium salt, distearyldimethyl ammonium salt and diisotetradecyldimethyl ammonium salt; and mono-long chain alkyldimethylamine salts such as hydrochloride salts, citrate salts or lactate salts of stearyldimethylamine, behenyldimethylamine, octadecyloxypropyldimethylamine, and dimethylaminopropyl stearic acid amide.

Solvent

The surfactant composition of the present invention may contain a solvent for the purpose of improving low temperature stability and cleaning performance. Examples of the solvent include alcohols, glycol ethers, alkylene glycol alkyl ethers and the like. Examples of the alcohol include monohydric alcohols such as ethanol, isopropyl alcohol and butanol; polyhydric alcohols such as ethylene glycol, propylene glycol, butylene glycol, hexylene glycol (2-methyl-2,4-pentanediol), 1,5-pentanediol, 1,6-hexanediol, and glycerin; and aromatic alcohols such as benzyl alcohol. Examples of the alkylene glycol ether include diethylene glycol, triethylene glycol, tetraethylene glycol, dipropylene glycol, and tripropylene glycol. Examples of the alkylene glycol alkyl ether include diethylene glycol monomethyl ether, triethylene glycol monomethyl ether, diethylene glycol monoethyl ether, dipropylene glycol monomethyl ether, dipropylene glycol monoethyl ether, tripropylene glycol monomethyl ether, diethylene glycol monobutyl ether, 1-methoxy-2-propanol, 1-ethoxy-2-propanol, 2-phenoxyethanol, diethylene glycol monophenyl ether, and triethylene glycol monophenyl ether.

In the present invention, there is no limitation to inclusion of the solvent, but from the viewpoint of sustainability, environmental burden, safety, etc., the content of the solvent in the surfactant composition is preferably 10% by mass or less, more preferably 4% by mass or less, even more preferably 1% by mass or less, still even more preferably 0.1% by mass or less, yet still even more preferably 0% by mass, that is, it is preferred that the surfactant composition does not contain a solvent.

The surfactant composition of the present invention can be prepared by mixing component A, component B, component C, and other components.

The order of mixing component A, component B, and component C is not particularly limited, and after mixing component A and component B, the mixture may be adjusted to a predetermined concentration by diluting with water, or component A and water may be mixed in advance, and component B and water may be premixed, and then the both mixed solutions may be mixed. Alternatively, component A and water may be mixed in advance, component B and water may be preliminarily mixed, and such mixed solutions of these may be mixed and diluted with water to adjust to a predetermined concentration.

In the case of preparing a surfactant composition containing other components, there is no particular limitation on the order of preparation, but after preparing a surfactant composition containing, for example, component A, component B and component C, the other components may be blended.

From the viewpoint of obtaining a uniformly dissolved surfactant composition, after mixing the components, the mixture is preferably allowed to stand at a predetermined temperature for a predetermined period of time. From the viewpoint of obtaining a uniformly dissolved surfactant composition, the temperature at which the composition is allowed to stand is preferably 10° C. or more, more preferably 15° C. or more, even more preferably 20° C. or more, still even more preferably 25° C. or more and from the viewpoint of economic efficiency, the temperature at which the composition is allowed to stand is preferably 80° C. or less, more preferably 70° C. or less, even more preferably 60° C. or less, still even more preferably 50° C. or less, yet still even more preferably 40° C. or less, furthermore preferably 30° C. or less. The time to stand still depends on the temperature, but is preferably 1 hour or more, more preferably 5 hours or more, even more preferably 12 hours or more, still even more preferably 18 hours or more, furthermore preferably 24 hours or more, even furthermore preferably 2 days or more, still even furthermore preferably 3 days or more, from the viewpoint of sufficiently uniform dissolution, and is preferably 1 month or less, more preferably 20 days or less, even more preferably 10 days or less, from the economical point of view.

The surfactant composition of the present invention contains a surfactant at a high concentration, is excellent in fluidity at from a high concentration to a low concentration, can greatly reduce the amount of organic solvent to be used, and can be suitably used as a liquid detergent. Further, the surfactant composition of the present invention can be applied to various kinds of water (dilution water) because it does not become clouded even when diluted with hard water or does not cause reduction of detergency. The surfactant composition of the present invention is used as a detergent, for example, a liquid detergent for clothing, a detergent for dishes, a cleaning agent for hair, a cleaning agent for body, a cleaning agent for precision parts, and a cleaning agent for hard surfaces. The surfactant composition of the present invention can be used for each cleaning application by adding to the water and dissolving in water.

The present invention and preferred embodiments of the present invention are described below.

<1>

A surfactant composition including component A, component B, and component C described below, wherein a total content of the component A and the component B is 35% by mass or more and 80% by mass or less and wherein the component A is at least one sulfonate compound selected from the group consisting of a hydroxyalkane sulfonate and an olefin sulfonate, the component B is a polyoxyalkylene alkyl ether, and the component C is water.

<2>

The surfactant composition according to <1>, wherein the sulfonate compound has a carbon number of preferably 12 or more, more preferably 14 or more, still more preferably 16 or more, and preferably 24 or less, more preferably 22 or less, still more preferably 20 or less, even still more preferably 18 or less.

<3>

The surfactant composition according to <1> or <2>, wherein the component A is a hydroxyalkane sulfonate (HAS) and an olefin sulfonate (IOS).

<4>

The surfactant composition according to <3>, wherein the mass ratio (hydroxy form/olefin form) of the content of the hydroxyalkane sulfonate to the content of the olefin sulfonate is preferably 50/50 to 99/1, more preferably 60/40 to 99/1, even more preferably 70/30 to 99/1, still even more preferably 75/25 to 99/1, yet still even more preferably 75/25 to 95/5.

<5>

The surfactant composition according to any one of <1> to <4>, wherein the sulfonate compound preferably contains 40% by mass or less, more preferably 35% by mass or less, even more preferably 30% by mass or less, still even more preferably 28% by mass or less of a sulfonate compound having a sulfonate group at the 2-position, and preferably contains 5% by mass or more of a sulfonate compound having a sulfonate group at the 2-position.

<6>

The surfactant composition according to any one of <1> to <5>, wherein the polyoxyalkylene alkyl ether is represented by general formula (1):

$$R—O-(AO)_n—H \quad (1)$$

wherein R is a hydrocarbon group having 8 to 22 carbon atoms, AO is an alkyleneoxy group, and n is 5 or more.

<7>

The surfactant composition according to <6>, wherein the number of carbon atoms of the hydrocarbon group is preferably 10 or more, more preferably 12 or more, and preferably 18 or less, more preferably 16 or less, even more preferably 14 or less.

<8>

The surfactant composition according to <6> or <7>, wherein the "n" represents an average number of moles of the alkyleneoxy group and is preferably 7 or more, more preferably 10 or more, even more preferably 12 or more, and preferably 100 or less, more preferably 40 or less, even more preferably 30 or less.

<9>

The surfactant composition according to any one of <6> to <8>, wherein the AO is preferably one or more kinds selected from an ethyleneoxy group and a propyleneoxy group; more preferably, the AO contains an ethyleneoxy group and a propyleneoxy group; even more preferably, the AO has a block structure comprising an ethyleneoxy group and a propyleneoxy group.

<10>

The surfactant composition according to any one of <6> to <9>, wherein the polyoxyalkylene alkyl ether is preferably lauryl ether added with 15 to 25 moles of ethyleneoxy groups, lauryl ether added with a total of 15 to 25 moles of ethyleneoxy groups and propyleneoxy groups, myristyl ether added with 15 to 25 moles of ethyleneoxy groups, and myristyl ether added with a total of 15 to 25 moles of ethyleneoxy groups and propyleneoxy groups, more preferably lauryl ether added with a total of 15 to 25 moles of ethyleneoxy groups and propyleneoxy groups.

<11>

The surfactant composition according to any one of <1> to <10>, wherein the total content of the component A and the component B is 35% by mass or more and 80% by mass or less, and can be 40% by mass or more, 45% by mass or more, 50% by mass or more, 55% by mass or more, or 60% by mass or more, and can be 75% by mass or less, 70% by mass or less, or 65% by mass or less.

<12>

The surfactant composition according to any one of <1> to <11>, wherein the mass ratio A/B of the content of the component A to the content of the component B is preferably from 20/80 to 80/20, more preferably from 30/70 to 70/30, even more preferably from 40/60 to 60/40.

<13>

The surfactant composition according to any one of <1> to <12>, wherein the content of the component A in the composition may be 5% by mass or more, 10% by mass or more, 15% by mass or more, 20% by mass or more, 30% by mass or more, 40% by mass or more, or 50% by mass or more, and the content of the component A in the composition may be 75% by mass or less, 70% by mass or less, 65% by mass or less, 60% by mass or less, or 55% by mass or less.

<14>

The surfactant composition according to any one of <1> to <13>, wherein the content of the component B in the composition may be 5% by mass or more, 10% by mass or more, 15% by mass or more, 20% by mass or more, 30% by mass or more, 40% by mass or more, or 50% by mass or more, and the content of the component B in the composition may be 75% by mass or less, 70% by mass or less, 65% by mass or less, 60% by mass or less, or 55% by mass or less.

<15>

The surfactant composition according to any one of <1> to <14>, wherein the content of the component C in the composition can be 5% by mass or more, 10% by mass or more, 15% by mass or more, 20% by mass or more, or 25% by mass or more, and 65% by mass or less, 60% by mass or less, 55% by mass or less, 50% by mass or less, 45% by mass or less, 40% by mass or less, or 35% by mass or less.

<16>

The surfactant composition according to any one of <1> to <15>, wherein the viscosity at 25° C. of the surfactant composition is preferably 8000 mPa's or less, more preferably 7000 mPa's or less, even more preferably 6000 mPa·s or less, still even more preferably 5000 mPa·s or less, further preferably 4000 mPa·s or less, furthermore preferably 3500 mPa·s or less, furthermore preferably 3000 mPa·s or less, furthermore preferably 2000 mPa·s or less, furthermore preferably 1000 mPa·s or less, furthermore preferably 500 mPa·s or less, furthermore preferably 300 mPa·s or less, furthermore preferably 200 mPa·s or less, and may be 0 mPa·s or more, 5 mPa·s or more, 10 mPa·s or more, 20 mPa·s or more, 30 mPa·s or more, 40 mPa·s or more, or 50 mPa·s or more.

<17>

The surfactant composition according to any one of <1> to <16>, wherein the surfactant composition is homogeneously dissolved preferably at 25° C.

<18>

The surfactant composition according to any one of <1> to <17>, wherein the Hazen color number (APHA) of the surfactant composition is preferably 550 or less, more preferably 400 or less, even more preferably 300 or less, still even more preferably 200 or less.

<19>

The surfactant composition according to any one of <1> to <18>, wherein the content of the solvent in the surfactant composition is preferably 10% by mass or less, more preferably 4% by mass or less, even more preferably 1% by mass or less, still even more preferably 0.1% by mass or less, yet still even more preferably 0% by mass.

<20>

The surfactant composition according to any one of <1> to <19>, which is a detergent.

<21>

A cleaning method using the surfactant composition according to any one of <1> to <19>.

<22>

Use of the surfactant composition according to any one of <1> to <19> as a detergent.

EXAMPLES

Hereinafter, the present invention will be described specifically based on Examples. Unless otherwise indicated in the table, the content of each component represents percent by mass. Various measurement methods are as follows.

<Measuring Method of Double Bond Position of Internal Olefin>

The double bond position of the internal olefin was measured by gas chromatography (hereinafter abbreviated as GC). Specifically, an internal olefin was reacted with dimethyl disulfide to obtain a dithioated derivative, and then the respective components were separated by GC. The double bond position of the internal olefin was determined from each peak area. The device used for the measurement and the analysis conditions are as follows: a GC device "HP6890" (manufactured by HEWLETT PACKARD), a column "Ultra-Alloy-1HT capillary column" (30 m×250 μm×0.15 μm, manufactured by Frontier Laboratories), a detector (hydrogen flame ion detector (FID)), injection temperature 300° C., detector temperature 350° C., He flow rate 4.6 mL/min.

<Method of Measuring Mass Ratio of Hydroxy Form/Olefin Form>

The mass ratio of the hydroxy form/olefin form of the sulfonate compound was measured by HPLC-MS. Specifically, the hydroxy form and the olefin form were separated by HPLC, and each was identified by applying to MS. As a result, each ratio was determined from the HPLC-MS peak area.

The device and conditions used for the measurement are as follows: HPLC device (trade name: Agilent Technologies 1100, manufactured by Agilent Technologies), column (trade name: L-column ODS 4.6×150 mm, manufactured by Chemicals Evaluation and Research Institute, Japan.), sample preparation (1000-fold dilution with methanol), eluent A (10 mM ammonium acetate added water), eluent B (10 mM ammonium acetate added methanol), gradient (0 minute (A/B=30/70%)→10 minutes (30/70%)→55 minutes (0/100%)→65 minutes (0/100%)→66 minutes (30/70%) →75 minutes (30/70%), MS device (trade name: Agilent Technologies 1100 MS SL (G 1946 D)), MS detection (negative ion detection m/z 60-1600, UV 240 nm).

<Method for Measuring Content of Internal Olefin Contained in Sulfonate Compound>

The content of the internal olefin contained in the sulfonate compound was measured by GC. Specifically, ethanol and petroleum ether were added to an aqueous solution containing a sulfonate compound, and then extraction was carried out to obtain an internal olefin in the petroleum ether phase. The amount of internal olefin was quantified from the GC peak area. The device used for the measurement and the analysis conditions are as follows: GC device "Agilent Technologies 6850" (manufactured by Agilent Technologies), column "Ultra-Alloy-1HT capillary column" (15 m×250 μm×0.15 μm, manufactured by Frontier Laboratories), detector (hydrogen flame ion detector (FID)), injection temperature 300° C., detector temperature 350° C., and He flow rate 3.8 mL/min.

<Method for Measuring Content of Inorganic Salt Contained in Sulfonate Compound>

The content of the inorganic salt was measured by potentiometric titration or neutralization titration. Specifically, the content of $Na_2SO_4$ was quantitatively determined by potentiometric titration of sulfate ion ($SO_4^{2-}$) Further, the content of NaOH was quantified by neutralization titration with a dilute hydrochloric acid.

<Measuring Method of Content of Paraffin Component>

The content of the paraffin component was measured by GC. Specifically, ethanol and petroleum ether were added to an aqueous solution containing a sulfonate compound, and then extraction was performed to obtain paraffin in a petroleum ether phase. As a result, the amount of paraffin was quantified from the GC peak area. The device used for the measurement and the analysis conditions are similar to the measurement of the content of the internal olefin in the raw material.

<Method for Measuring Content of Sulfonate Compound Having Sulfonate Group at 2-Position>

The bonding position of the sulfonate group was measured by GC. Specifically, the resulting sulfonate compound was reacted with trimethylsilyldiazomethane to give a methylesterified derivative, and then each component was separated by GC. The content of the sulfonate compound having a sulfonate group at the 2-position was calculated using the respective peak area ratios as mass ratios. The device used for the measurement and the analysis conditions are as follows: GC device (trade name: "Agilent Technologies 6850", manufactured by Agilent Technologies), column (trade name: HP-1 capillary column 30 m×320 μm×0.25 μm, manufactured by Agilent Technologies), detector (hydrogen flame ion detector (FID)), injection temperature 300° C., detector temperature 300° C., He flow rate 1.0 mL/min, and oven (60° C. (0 minute)→10° C./minute→300° C. (10 minutes)).

<Measuring Method of Viscosity of Surfactant Composition>

The prepared surfactant composition was allowed to stand at room temperature for 3 days or longer and then the viscosity at 25° C. of the surfactant composition was measured with a tuning fork type vibrational viscometer (VIBRO VISCOMETER SV-10, manufactured by A & D Company Limited.). Continuous measurement was conducted for 3 minutes from the start of measurement (data update interval: 5 seconds), and the average value was taken as the viscosity of the surfactant composition. The results are shown in Table 1. In addition, when the viscosity was 12000 mPa·s or more and exceeded the measurement limit of the viscometer, the viscosity was described as "no fluidity".

<Evaluation of Solubility of Surfactant Composition in 20° DH Hard Water>

Calcium chloride dihydrate (83.88 g) and magnesium chloride hexahydrate (29.00 g) were dissolved in 1 L of ion exchange water to prepare 4000° DH hard water.

A surfactant is mixed in a screw tube bottle (manufactured by Maruemu Corporation) so that the mixing ratio is as shown in Table 1, and further ion exchange water was added so that the total surfactant concentration became 10%, and the mixture was stirred until it became homogeneous to prepare an aqueous surfactant solution.

The prepared surfactant aqueous solution and 4000° DH hard water were mixed and diluted with ion exchanged water so that the surfactant concentration was 500 ppm, 1000 ppm, and 2000 ppm, and the hardness of the aqueous solution was 20° DH, and then the diluted solution was allowed to stand at 25° C. for one day.

The appearance of the obtained aqueous solution was visually confirmed and the solution was evaluated according to the following criteria. The results are shown in Table 1.

A: The solution is transparent (transmittance: 85% or more)

B: The solution is slightly cloudy (transmittance: 50% or more and less than 85%)

C: The solution is cloudy (transmittance: less than 50%)

Further, the transmittance of the obtained aqueous solution was measured with an ultraviolet-visible near-infrared spectrophotometer (V-700, manufactured by JASCO Corporation). Measurement conditions are as follows: measurement wavelength: 420 nm, response: 0.96 sec, bandwidth: 2.0 nm, integration: 3 times, measurement cell length: 10 mm. The results are shown in Table 1.

<Measurement Method of Hue>

Hazen color number (APHA) was measured using a petroleum product color tester "OME 2000" (manufactured by Nippon Denshoku Industries Co., Ltd.) of a tristimulus-value direct reading type. For measurement of hue, a surfactant solution having a total concentration of surfactant of 35% by mass was prepared and used.

<Evaluation of Detergency>

In order to demonstrate the effect of the present invention, a tergotometer (MS-8212, manufactured by Ueshima) was used as a washing device. The tergotometer is a rotary type device that performs washing and is generally used as a model washing device of a fully automatic washing machine for home use, a drum type fully automatic washing machine, a pulsator type fully automatic washing machine for home use or an agitator type fully automatic washing machine for home use. Especially, the tergtometer is a model washing device corresponding to the pulsator type fully automatic washing machine for home use or the agitator type fully automatic washing machine for home use.

A cloth artificially stained with model sebum was prepared by attaching an artificial staining liquid of model sebum having the following composition to a cloth. The attachment of the artificial staining liquid of model sebum to the cloth was carried out by printing the artificial staining liquid on the cloth using a gravure roll coater (described in JP-A-H7-270395) The process of preparing the cloth artificially stained with model sebum by attaching the artificial staining liquid of model sebum to the cloth was performed under the conditions as follows: a cell volume of gravure roll of 58 $cm^3/m^2$ (corresponding to a contamination bath of JP-A-H7-270395), a coating speed of 1.0 m/min, a drying temperature of 100° C. and a drying time of 1 minute. Cotton white cloth (#2003, 100% cotton woven with white fabric, supplied by Tanigashira Shoten, 4-11-15 Komatsu, Higashiyodogawa-ku, Osaka-shi, Osaka) was used as the cloth.

The composition of artificial staining liquid of model sebum is as follows: 0.32% by mass of lauric acid, 1.06% by mass of myristic acid, 0.54% by mass of pentadecanoic acid, 2.10% by mass of palmitic acid, 0.18% by mass of heptadecanoic acid, 11.74% by mass of oleic acid, 0.84% by mass of linoleic acid, 27.30% by mass of triolein, 3.70% by mass of n-hexadecyl palmitate, 8.20% by mass of squalene, 2.04% by mass of egg yolk lecithin liquid crystal material, 0.95% by mass of soybean lecithin, 0.24% by mass of arginine hydrochloride, 0.10% by mass of L-histidine, 0.07% by mass of L-serine, 1.68% by mass of calcium pantothenate, 6.69% by mass of mud (average particle diameter 10 m), 0.02% by mass of carbon black, and water as the balance (total 100% by mass).

Each (6 cm×6 cm) of five sheets of cloth stained with model sebum prepared above was washed with a tergotometer at 85 rpm for 10 minutes. The washing conditions are as follows: surfactant concentration 1000 ppm, water temperature 25° C., water hardness 20° DH. After washing, rinsing was performed for 3 minutes with tap water (20° C.). The reflectivity of the original cloth before staining and the cloth before and after washing was measured at 550 nm by a colorimetric color difference meter (Z-300A, manufactured by NIPPON DENSHOKU INDUSTRIES CO., LTD.), and the washing rate (%) was determined by the following equation (washing rate is expressed in terms of an average value of the washing rates of 5 sheets).

Washing rate %=100×[(Reflectivity after washing−Reflectivity before washing)/(Reflectivity of original cloth−Reflectivity before washing)]

Production Method of Internal Olefin

Production Example A

Into a flask equipped with a stirrer, 7000 g (28.9 moles) of 1-hexadecanol (product name: KALCOL 6098, manufactured by Kao Corporation) and 700 g of γ-alumina (STREM Chemicals, Inc.) as a solid acid catalyst (10% by mass relative to the raw material alcohol) were placed, and the reaction was carried out for 5 hours while circulating nitrogen gas (7000 mL/min) into the system at 280° C. with stirring. The alcohol conversion rate after completion of the reaction was 100%, and the purity of C16 internal olefin was 99.7%. The obtained crude internal olefin was transferred to a distillation flask and distilled at from 136 to 160° C./4.0 mmHg, whereby 100% pure internal olefin having 16 carbon atoms was obtained. The double bond distribution in the resulting internal olefin was 0.5% by mass at C-1 position, 16.5% by mass at C-2 position, 15.4% by mass at C-3 position, 16.4% by mass at C-4 position, 17.2% by mass at C-5 position, 14.2% by mass at C-6 position, and 19.8% by mass at the total of C-7 and C-8 positions.

Production Example B

Into a flask equipped with a stirrer, 7000 g (28.9 moles) of 1-hexadecanol (product name: KALCOL 6098, manufactured by Kao Corporation) and 700 g of γ-alumina (STREM Chemicals, Inc.) as a solid acid catalyst (10% by mass relative to the raw material alcohol) were placed, and the reaction was carried out for 3 hours while circulating nitrogen gas (7000 mL/min) into the system at 280° C. with stirring. The alcohol conversion rate after completion of the reaction was 100%, and the purity of C16 internal olefin was 99.6%. The obtained crude internal olefin was transferred to a distillation flask and distilled at from 136 to 160° C./4.0 mmHg, whereby 100% pure internal olefin having 16 carbon atoms was obtained. The double bond distribution in the resulting internal olefin was 0.5% by mass at C-1 position, 30.1% by mass at C-2 position, 25.5% by mass at C-3 position, 18.9% by mass at C-4 position, 11.1% by mass at C-5 position, 7.0% by mass at C-6 position, and 7.0% by mass at the total of C-7 and C-8 positions.

Production Example C

Into a flask equipped with a stirrer, 7000 g (25.9 moles) of 1-octadecanol (product name: KALCOL 8098, manufactured by Kao Corporation) and 1050 g of γ-alumina (STREM Chemicals, Inc.) as a solid acid catalyst (15% by mass relative to the raw material alcohol) were placed, and the reaction was carried out for 10 hours while circulating nitrogen gas (7000 mL/min) into the system at 285° C. with stirring. The alcohol conversion rate after completion of the reaction was 100%, and the purity of C18 internal olefin was 98.2%. The obtained crude internal olefin was transferred to a distillation flask and distilled at from 148 to 158° C./0.5 mmHg, whereby 100% pure internal olefin having 18 carbon atoms was obtained. The double bond distribution in the resulting internal olefin was 0.5% by mass at C-1 position, 25.0% by mass at C-2 position, 22.8% by mass at C-3 position, 19.1% by mass at C-4 position, 14.0% by mass at C-5 position, 7.4% by mass at C-6 position, 5.4% by mass at C-7 position, and 5.8% by mass at the total of C-8 and C-9 positions.

Method for Producing Sulfonate Compound

Production Example 1

Sulfonation reaction of the internal olefin having 16 carbon atoms produced in Production Example A was carried out with sulfur trioxide gas having an $SO_3$ concentration of 2.8% by volume using a thin film type sulfonation reactor (inner diameter 14 mmφ, length 4 m) while passing cooling water at 20° C. through an external jacket of the reactor. The reaction molar ratio of $SO_3$/internal olefin was set to 1.09.

The obtained sulfonated product was added to an aqueous alkali solution to which sodium hydroxide was added so as to be 1.2 molar times the theoretical acid value (AV), and neutralized at 30° C. for 1 hour with stirring. The neutralized product was hydrolyzed by heating in an autoclave at 160° C. for 1 hour to obtain a crude product containing a sodium sulfonate compound having 16 carbon atoms.

The obtained crude product (300 g) was transferred to a separatory funnel, and 300 mL of ethanol was added thereto. Then, 300 mL of petroleum ether was added per one time to extract and remove oil-soluble impurities. At this time, the inorganic compounds (main ingredient is sodium sulfate) precipitated at the oil/water interface by the addition of ethanol were also separated and removed from the aqueous phase by oil-water separation procedure, and this procedure was carried out three times. The aqueous phase was evaporated to dryness to obtain a sodium sulfonate compound having 16 carbon atoms (A-1). The content of the raw material internal olefin in the obtained sodium sulfonate compound having 16 carbon atoms was less than 100 ppm (less than the GC detection lower limit), the content of the inorganic compound was 0.2% by mass, and the content of the paraffin component was 0.2% by mass. In addition, the content of the sodium sulfonate compound having 16 carbon atoms in which the sulfonate group is present at the 2-position was 9.3% by mass. Further, the content of the hydroxy form (HAS) in the sodium sulfonate compound having 16 carbon atoms was 84.2% by mass, and the content of the olefin form (IOS) was 14.4% by mass. The remaining was 1.0% by mass of water.

Production Example 2

Sodium sulfonate compound having 16 carbon atoms (A-2) was obtained under the same conditions as in Production Example 1 except that the internal olefin having 16 carbon atoms produced in Production Example B was used. The content of the raw material internal olefin in the obtained sodium sulfonate compound having 16 carbon atoms was less than 100 ppm (less than the GC detection lower limit), the content of the inorganic compound was 0.2% by mass, and the content of the paraffin component was below the detection limit. In addition, the content of the sodium sulfonate compound having 16 carbon atoms in which the sulfonate group is present at the 2-position was 19.9% by mass. Further, the content of the hydroxy form (HAS) in the sodium sulfonate compound having 16 carbon atoms was 83.6% by mass, and the content of the olefin form (IOS) was 15.1% by mass. The remaining was 1.1% by mass of water.

Production Example 3

Sodium sulfonate compound having 18 carbon atoms (A-5) was obtained under the same conditions as in Production Example 1 except that the internal olefin having 18 carbon atoms produced in Production Example C was used. The content of the raw material internal olefin in the obtained sodium sulfonate compound having 18 carbon atoms was less than 100 ppm (less than the GC detection lower limit), the content of the inorganic compound was 0.4% by mass, and the content of the paraffin component was below the detection limit. In addition, the content of the sodium sulfonate compound having 18 carbon atoms in which the sulfonate group is present at the 2-position was 15.0% by mass. Further, the content of the hydroxy form (HAS) in the sodium sulfonate compound having 18 carbon atoms was 84.4% by mass, and the content of the olefin form (IOS) was 15.6% by mass.

Production Example 4

Using the internal olefin having 18 carbon atoms produced in Production Example C, the sulfonation reaction was carried out under the same conditions as in Production Example 1. Subsequently, the obtained sulfonated product was added to an alkaline aqueous solution to which sodium hydroxide was added so as to be 1.2 molar times the theoretical acid value (AV), neutralized at 60° C. for 1 hour with stirring, and hydrolyzed and extracted under the same conditions as in Production Example 1 to obtain a sodium sulfonate compound having 18 carbon atoms (A-8). The content of the raw material internal olefin in the obtained sodium sulfonate compound having 18 carbon atoms was less than 100 ppm (less than the GC detection lower limit), the content of the inorganic compound was 0.1% by mass, and the content of the paraffin component was below the detection lower limit. In addition, the content of the sodium sulfonate compound having 18 carbon atoms in which the sulfonate group is present at the 2-position was 15.0% by mass. Further, the content of the hydroxy form (HAS) in the sodium sulfonate compound having 18 carbon atoms was 55.1% by mass, and the content of the olefin form (IOS) was 44.9% by mass.

Preparation of Surfactant Composition

Example 1

The sodium sulfonate compound having 16 carbon atoms (A-1) prepared in Production Example 1 and polyoxyalkylene alkyl ether (B-1) represented by the following formula were taken in a beaker using the formulation shown in Table 1. An appropriate amount of water was added thereto, and the mixture was warmed to 60° C. and mixed. After cooling the mixture to room temperature, water was supplemented, and the pH was adjusted to 6 with a pH adjusting agent to prepare a surfactant composition.

$$R—O\text{-}(EO)_a—(PO)_b\text{-}(EO)_c—H \quad (B\text{-}1)$$

In the formula, B-1 is a compound obtained by a block addition reaction of 9 moles of ethylene oxide, 2 moles of propylene oxide, and 9 moles of ethylene oxide in this order relative to 1 mole of a primary linear alcohol having 10 to 14 carbon atoms derived from coconut oil; R is a linear alkyl group having 10 to 14 carbon atoms; a is 9; b is 2; and c is 9.

Examples 2 to 11 and Comparative Examples 1 to 8

Surfactant compositions were prepared in the same manner as in Example 1 except that the raw materials and formulations shown in Tables 1 and 2 were employed. A-3, A-4, A-6, A-7, and B-2 in Table 1 and Table 2 are the following compounds.

A-3: Di (2-ethylhexyl) sodium sulfosuccinate (Aerosol OT, manufactured by Wako Pure Chemical Industries, Ltd.)

A-4: Sodium alkylbenzene sulfonate (G-65, manufactured by Kao Corporation)

A-6: A mixture of A-5 and A-8, wherein the content of HAS is 75% by mass and the content of IOS is 25% by mass.

A-7: A mixture of A-5 and A-8, wherein the content of HAS is 65% by mass and the content of IOS is 35% by mass.

B-2: Polyoxyethylene lauryl ether (EMULGEN 120, manufactured by Kao Corporation)

TABLE 1

| | Component A | | | A/B Ratio | A + B Total | | Evaluation of solubility Surfactant concentration: 500 ppm | |
|---|---|---|---|---|---|---|---|---|
| | Kind | HAS/IOS | Component B | (By mass) | concentration (% by mass) | Viscosity mPa · s | Appearance | Transmittance (%) |
| Example 1 | A-1 | 85/15 | B-1 | 50/50 | 40 | 188.6 | A | >99.9 |
| | | | | | 50 | 276.2 | | |
| | | | | | 60 | 284.8 | | |
| | | | | | 70 | 181.6 | | |
| | | | | | 80 | 438.0 | | |

TABLE 1-continued

| | | | | | | | | |
|---|---|---|---|---|---|---|---|---|
| Example 2 | | | | 20/80 | 40 | 296.5 | A | 99.9 |
| | | | | | 50 | 476.1 | | |
| | | | | | 60 | 471.9 | | |
| | | | | | 70 | 307.5 | | |
| | | | | | 80 | 385.6 | | |
| Example 3 | | | | 80/20 | 40 | 170.6 | A | 98.7 |
| | | | | | 50 | 310.5 | | |
| | | | | | 60 | 673.7 | | |
| | | | | | 70 | 620.5 | | |
| | | | | | 80 | 3290.4 | | |
| Comparative Example 1 | | | — | 100/0 | 80 | No fluidity | C | 2.5 |
| Comparative Example 2 | — | — | B-1 | 0/100 | 40 | No fluidity | A | 99.5 |
| | | | | | 50 | | | |
| | | | | | 60 | | | |
| Example 4 | A-2 | 84/16 | | 60/40 | 40 | 652.5 | A | >99.9 |
| | | | | | 50 | 904.4 | | |
| | | | | | 60 | 524.7 | | |
| | | | | | 70 | 652.5 | | |
| | | | | | 80 | 1089.6 | | |
| Example 5 | | | | 70/30 | 40 | 822.3 | A | >99.9 |
| | | | | | 50 | 1501.8 | | |
| | | | | | 60 | 1193.2 | | |
| | | | | | 70 | 822.3 | | |
| | | | | | 80 | 1444.5 | | |
| Example 6 | | | | 40/60 | 40 | 175.8 | A | >99.9 |
| | | | | | 50 | 431.3 | | |
| | | | | | 60 | 646.9 | | |
| | | | | | 70 | 336.5 | | |
| | | | | | 80 | 409.0 | | |
| Comparative Example 3 | | | — | 100/0 | 40 | No fluidity | C | 3.9 |
| | | | | | 50 | No fluidity | | |
| | | | | | 60 | No fluidity | | |
| | | | | | 70 | 11441.35 | | |
| | | | | | 80 | No fluidity | | |
| Comparative Example 4 | A-3 | — | B-1 | 80/20 | 80 | Partial gelation; Layer with no fluidity is present. | B | 80.93 |
| Comparative Example 5 | A-4 | — | | 80/20 | 70 | No fluidity | C | 3.17 |

| | Evaluation of solubility | | | | | |
|---|---|---|---|---|---|---|
| | Surfactant concentration: 1000 ppm | | Surfactant concentration: 2000 ppm | | | Washing |
| | Appearance | Transmittance (%) | Appearance | Transmittance (%) | Hue (APHA) | rate (%) |
| Example 1 | A | 99.7 | A | 99.9 | — | — |
| Example 2 | A | 98.7 | A | 99.7 | — | — |
| Example 3 | A | 91.6 | A | 85.2 | — | 32.6 |
| Comparative Example 1 | C | 0.6 | C | 0.1 | — | 17.8 |
| Comparative Example 2 | A | >99.9 | A | 99.4 | — | — |
| Example 4 | A | >99.9 | A | >99.9 | — | 35.7 |
| Example 5 | A | 99.8 | A | 99.6 | — | — |
| Example 6 | A | 99.1 | A | 99.4 | — | — |
| Comparative Example 3 | C | 0.7 | C | 1 | — | 24.1 |
| Comparative Example 4 | C | 44.88 | C | 21.21 | — | 16.4 |
| Comparative Example 5 | C | 0.45 | C | 0.18 | — | — |

TABLE 2

| | Component A | | | A/B Ratio | A + B Total | | Evaluation of solubility Surfactant concentration: 500 ppm | |
|---|---|---|---|---|---|---|---|---|
| | Kind | HAS/ IOS | Component B | (By mass) | concentration (% by mass) | Viscosity mPa · s | Appearance | Transmittance (%) |
| Example 7 | A-1 | 85/15 | B-2 | 60/40 | 35 | 514 | A | 99.87 |
| | | | | | 60 | 793.8 | | |
| | | | | | 80 | 504.5 | | |
| Example 8 | A-5 | 84/16 | B-1 | 60/40 | 35 | 648.5 | A | 99.82 |
| | | | | | 60 | 1000 | | |
| | | | | | 80 | 1481.3 | | |
| Example 9 | A-6 | 75/25 | | 60/40 | 35 | 500 | A | >99.9 |
| | | | | | 60 | 983.9 | | |
| | | | | | 80 | 1011.2 | | |
| Example 10 | A-7 | 65/35 | | 60/40 | 35 | 346.8 | A | >99.9 |
| | | | | | 60 | 1375.5 | | |
| | | | | | 80 | 816.4 | | |
| Example 11 | A-8 | 55/45 | | 60/40 | 35 | 313.8 | A | >99.9 |
| | | | | | 60 | 1758.6 | | |
| | | | | | 80 | 1101.3 | | |
| Comparative Example 6 | A-5 | 84/16 | — | 100/0 | 35 | No fluidity | C | 6.6 |
| Comparative Example 7 | A-8 | 55/45 | — | 100/0 | 35 | No fluidity | — | — |
| Comparative Example 8 | — | — | B-2 | 0/100 | 60 | No fluidity | — | — |

| | Evaluation of solubility | | | | | |
|---|---|---|---|---|---|---|
| | Surfactant concentration: 1000 ppm | | Surfactant concentration: 2000 ppm | | | Washing |
| | Appearance | Transmittance (%) | Appearance | Transmittance (%) | Hue (APHA) | rate (%) |
| Example 7 | A | >99.9 | A | 99.72 | — | — |
| Example 8 | A | >99.9 | A | 99.85 | 37 | — |
| Example 9 | A | >99.9 | A | 99.53 | 195 | — |
| Example 10 | A | >99.9 | A | >99.9 | 312 | — |
| Example 11 | A | >99.9 | A | >99.9 | 505 | — |
| Comparative Example 6 | C | 2.5 | C | 19.5 | — | — |
| Comparative Example 7 | — | — | — | — | — | — |
| Comparative Example 8 | — | — | — | — | — | — |

From Tables 1 and 2, it is understood that the surfactant compositions of Examples 1 to 11 in which the total content of HAS and IOS (component A) and polyoxyalkylene alkyl ether (component B) are within the content specified by the present invention has very low viscosity, has fluidity in a wide concentration range, does not become clouded even when it is diluted with hard water, and is excellent in solubility to hard water, despite the content of the components A and B at a high concentration. On the other hand, the surfactant compositions of Comparative Examples 1 to 3 and 6 to 8 which did not contain the component A or the component B had very high viscosity at any concentration and did not have fluidity. In addition, the surfactant compositions of Comparative Examples 1 to 3 and 6 to 8 were cloudy when diluted with hard water and had poor solubility in hard water. The surfactant compositions of Comparative Examples 4 and 5 containing an anionic surfactant as the component A other than HAS and IOS became gelled in a high concentration range, had very high viscosity and did not have fluidity. Further, the surfactant compositions of Comparative Examples 4 and 5 became clouded when diluted with hard water and were poorly soluble in hard water.

INDUSTRIAL APPLICABILITY

The surfactant composition of the present invention is useful as a detergent for various uses.

The invention claimed is:

1. A surfactant composition including component A, component B, and component C described below, wherein a total content of the component A and the component B is 45% by mass or more and 80% by mass or less and wherein the component A is a hydroxyalkane sulfonate having 12 to 24 carbon atoms and an internal olefin sulfonate having 12 to 24 carbon atoms, the component B is a polyoxyalkylene alkyl ether of the formula R—O-$(AO)_n$—H wherein R is a hydrocarbon group having 8 to 22 carbon atoms, AO is ethylene oxy, propylene oxy, or butylene oxy, and n is 5 or more and 100 or less, and the component C is water, wherein a viscosity of the composition measured by a tuning fork type vibrational viscometer at 25° C. is 8000 mPa·s or less.

2. The surfactant composition according to claim 1, wherein a mass ratio AB of the content of the component A to the content of the component B is from 20/80 to 80/20.

3. The surfactant composition according to claim 1, wherein the sulfonate compound contains 40% by mass or less of a sulfonate compound having a sulfonic acid group at 2-position.

4. The surfactant composition according to claim 1, wherein the mass ratio of the content of the hydroxyalkane sulfonate to the content of the olefin sulfonate is from 50/50 to 99/1.

5. The surfactant composition according to claim 1, which is a detergent.

6. A cleaning method using the surfactant composition according to claim 1.

7. The surfactant composition according to claim 2, wherein the sulfonate compound contains 40% by mass or less of a sulfonate compound having a sulfonic acid group at 2-position.

8. The surfactant composition according to claim 2, wherein the mass ratio of the content of the hydroxyalkane sulfonate to the content of the olefin sulfonate is from 50/50 to 99/1.

9. The surfactant composition according to claim 3, wherein the mass ratio of the content of the hydroxyalkane sulfonate to the content of the olefin sulfonate is from 50/50 to 99/1.

* * * * *